United States Patent [19]

Noschese

[11] Patent Number: 4,871,315

[45] Date of Patent: Oct. 3, 1989

[54] RIBBON CABLE CONNECTOR

[75] Inventor: Rocco Noschese, Wilton, Conn.

[73] Assignee: Burndy Corporation, Norwalk, Conn.

[21] Appl. No.: 175,209

[22] Filed: Mar. 30, 1988

[51] Int. Cl.[4] ..... H01R 9/09

[52] U.S. Cl. ..... 439/67; 439/77; 439/329; 439/493; 439/499

[58] Field of Search ..... 439/67, 492–494, 439/498, 499, 329, 77

[56] References Cited

U.S. PATENT DOCUMENTS

| | | | |
|---|---|---|---|
| 3,629,787 | 12/1971 | Wilson | 439/67 |
| 4,087,146 | 5/1978 | Hudson, Jr. | 439/67 |
| 4,691,972 | 9/1987 | Gordon | 439/493 |
| 4,695,108 | 9/1987 | Ichitsubo | 439/499 |
| 4,718,859 | 1/1988 | Gardner | 439/493 |
| 4,768,971 | 9/1988 | Simpson | 439/493 |
| 4,770,645 | 9/1988 | Antes | 439/493 |

*Primary Examiner*—P. Austin Bradley
*Attorney, Agent, or Firm*—Perman & Green

[57] ABSTRACT

An electrical connector terminates ribbon cable intended for electrical connection to a PCB. The connector presents multiple contacts from the ribbon cable for engagement with mating terminals on the PCB as the connector is first moved into position for mounting on the PCB. Guide pins on the connector are slidably received in associated guide holes in the PCB to assure that each contact is properly positioned to engage its mating terminal. Thereupon, fasteners are tightened for firmly securing the connector to the PCB and, in the process, the contacts are moved relative to their mating terminals in a wiping action while still in engagement with them. Relative movement between the contacts and the terminals ceases when the fasteners are fully tightened. Individual groups of contacts are independently biased into engagement with the terminals with a predetermined minimum of force. The ends of the cable are slitted in the contact region to insure that one group of contacts is independent from its neighboring groups of contacts, thereby maximizing positive engagement between the contacts and their mating terminals.

51 Claims, 7 Drawing Sheets

RIBBON CABLE CONNECTOR

BACKGROUND OF THE INVENTION

I. Field of the Invention

The present invention relates to an electrical connector assembly capable of simultaneously connecting, mechanically and electrically, a plurality of contacts on multiconductor stripline ribbon cable to mating terminals on a printed circuit board. This is achieved with a construction assuring electrical paths of minimized length and a minimal number of electrical interfaces. The connector assembly provides a wiping action of the cable contacts relative to mating conductive terminals on the printed circuit board to thereby achieve an optimum electrical connection. The invention also maintains a relationship between signal and ground circuits which is controlled to minimize any disturbance of the impedance required in the system.

II. Description of the Prior Art

In the past, it has been difficult to achieve uniformity of contact engagement of ribbon cable with mating terminals on a printed circuit board (PCB), particularly when the number of mating contacts and terminals is very large. Often times, the cable is semi-rigid permitting marginal flexibility, at best, between adjacent contact leads. As a result, in the event of irregularity among PCB terminals, there is likely to be an insufficient relative flexibility among the mating contacts to assure a proper electrical connection with their mating conductive terminals.

However, even where there is uniformity of contact engagement, it is not unusual for marginal electrical connections to result between mating contacts and terminals nonetheless because of surface contaminants, films, and the like. Furthermore, because of the high density of the contacts and terminals, it is not generally possible to clean the respective contacts and terminals prior to mounting a connector to the PCB. Also, maintaining adequate impedance control through the disconnectable interface was heretofore difficult to achieve in a dense pattern and in a short length.

SUMMARY OF THE INVENTION

The present invention recognizes the problems of prior art connectors, as just described, and offers a solution to those problems. To this end, an electrical connector is disclosed which terminates stripline ribbon cable or microstrip intended for electrical connection to a PCB. The connector presents multiple contacts of the ribbon cable for engagement with mating terminals on the PCB as the connector is first moved into position for mounting on the PCB. Guide pins on the connector are slidably received in associated guide holes in the PCB to assure that each contact is properly positioned to engage its mating terminal. Thereupon, fasteners are tightened for firmly securing the connector to the PCB and, in the process, the contacts are moved relative to their mating terminals in a wiping action while still in engagement with them. Relative movement between the contacts and the terminals ceases when the fasteners are fully tightened. Individual groups of contacts are independently biased into engagement with the terminals with a predetermined minimum of force. The ends of the cable are slitted in the contact region to insure that one group of contacts is independent from its neighboring groups of contacts, thereby maximizing positive engagement between the contacts and their mating terminals.

The invention provides a high density connector which assures connection simultaneously of a large number of contacts from a plurality of ribbon cables to a similar number of terminals on a PCB. The contacts are positioned in a housing so as to lie substantially in a common plane. Similarly, the terminals on the PCB all lie substantially in a common plane. The housing has a planar cam surface which is angularly disposed in relation to the plane of engagement of the contacts and the terminals. Additionally, an actuating block is mounted onto the PCB by means of fasteners so as to overlie the housing and is also formed with a planar cam surface which slidably engages the cam surface on the housing.

As the actuating block is advanced toward the PCB upon tightening of the fasteners by means of which it is engaged to the PCB, the cam surface on the actuating block, causes the housing to move relative to the PCB. In this manner, the contacts, already in engagement with the terminals are caused to wipe across the terminals. When the actuating block reaches a final position at which it is firmly mounted on the PCB, the fasteners themselves being completely tightened, each of the contacts will have achieved a final position as well engaged with its mating terminal. A spring intermediate the actuating block and the housing serves to bias the housing in the direction of the PCB and thereby assures firm engagement between the contacts and their mating terminals. The wiping action just performed assures that any surface contaminants, films, or the like on either the contacts or on the terminals or on both of them will have been removed by frictional action between them by the time the housing reaches its final position.

By reason of the construction disclosed, the connector can be readily mounted to a PCB and just as readily dismounted therefrom. Although the mounting operation is a rapid one, when achieved, the contacts are firmly and immovably engaged with their mating terminals.

Other and further features, objects, advantages, and benefits of the invention will become apparent from the following description taken in conjunction with the following drawings. It is to be understood that both the foregoing general description and the following detailed description are exemplary and explanatory but are not restrictive of the invention. The accompanying drawings which are incorporated in, and constitute a part of the invention, illustrate one embodiment of the invention and, together with a description, serve to explain the principles of the invention in general terms. Like numerals refer to like parts throughout.

DETAILED DESCRIPTION OF THE DRAWINGS

Figure 5:
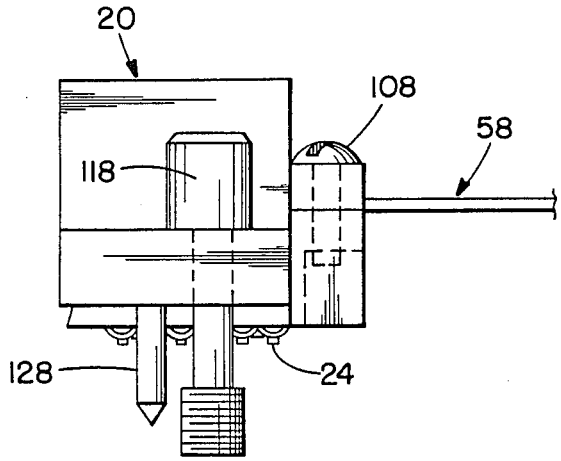
Figure 3:
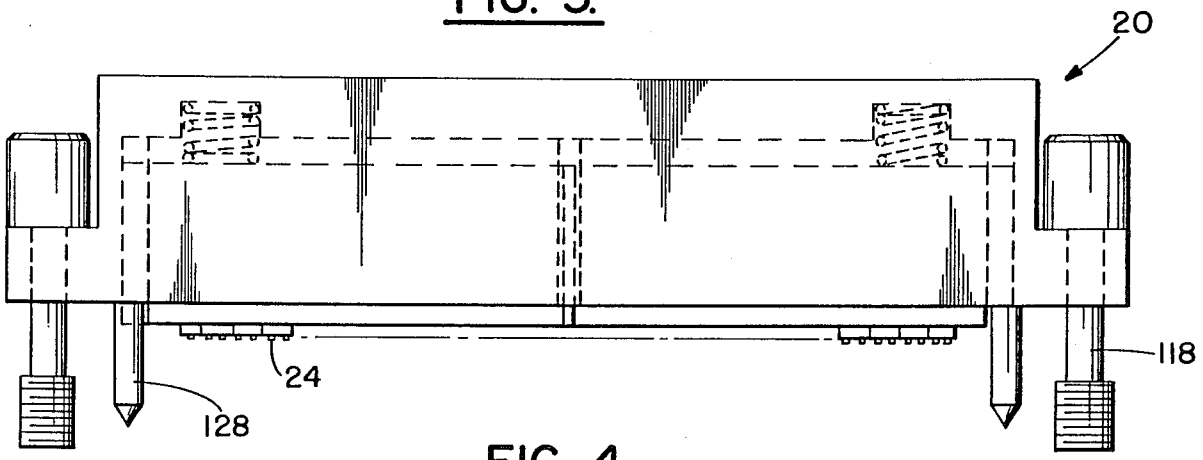
Figure 4:
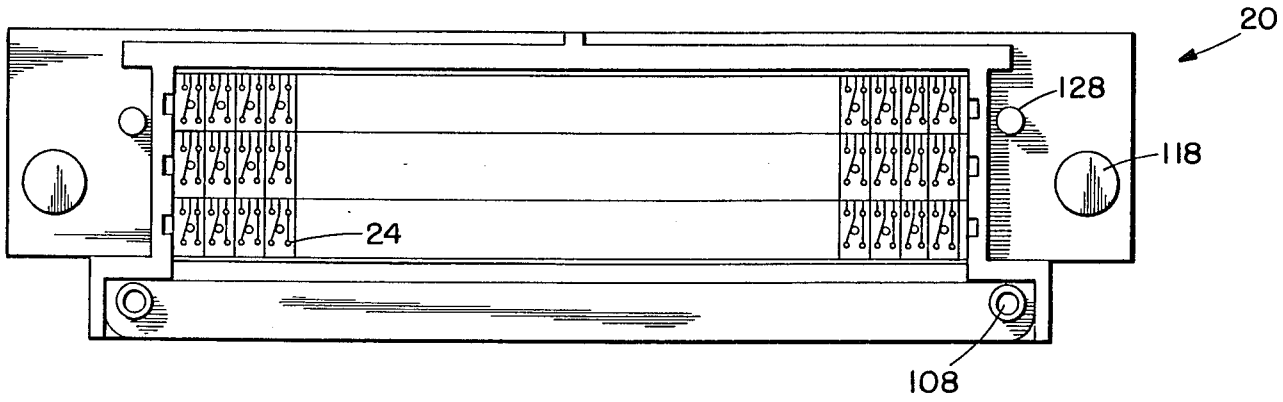
Figure 6:
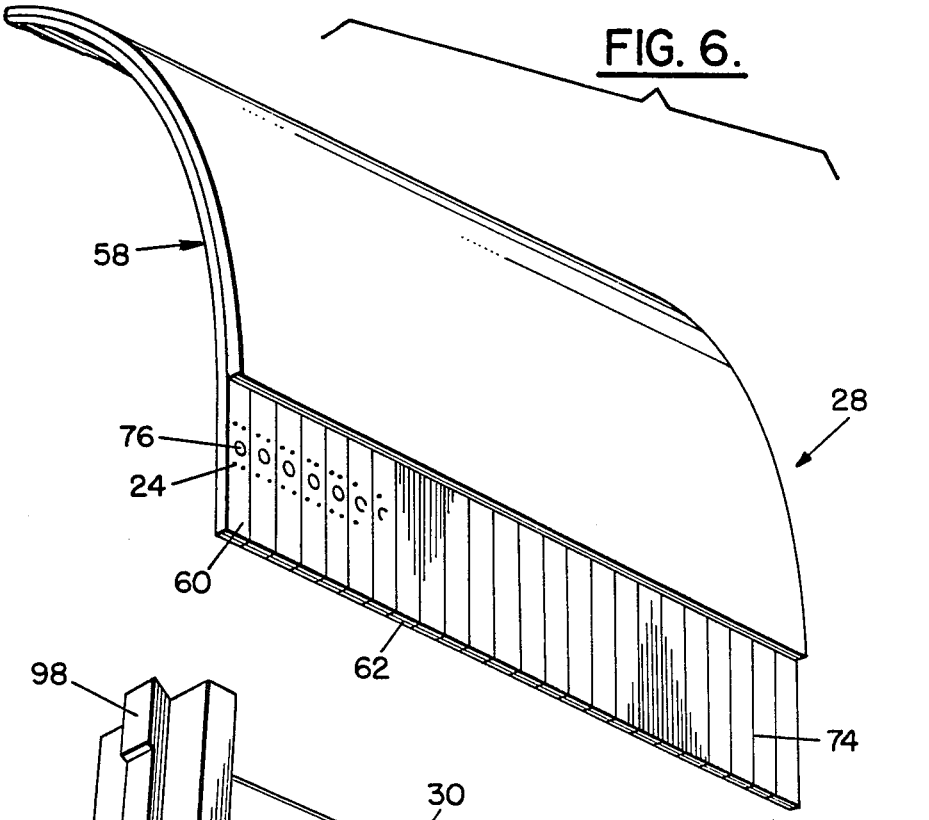
Figure 6:
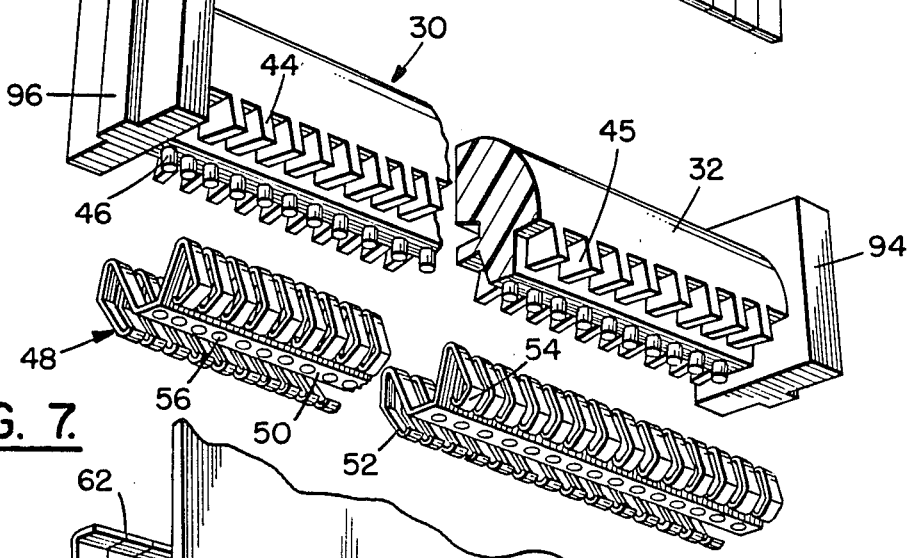
Figure 7:
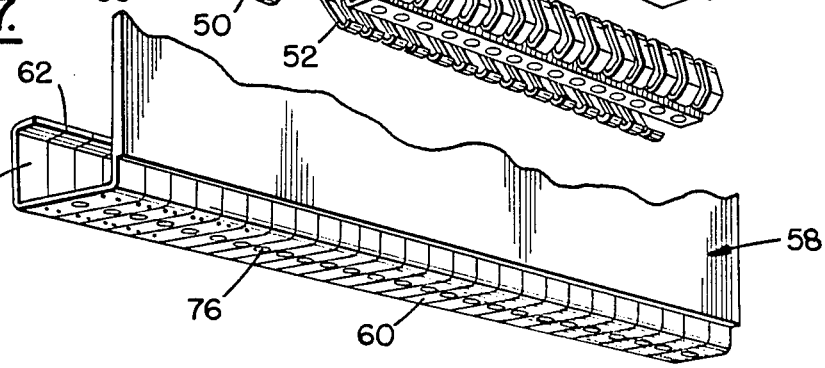
Figure 8:
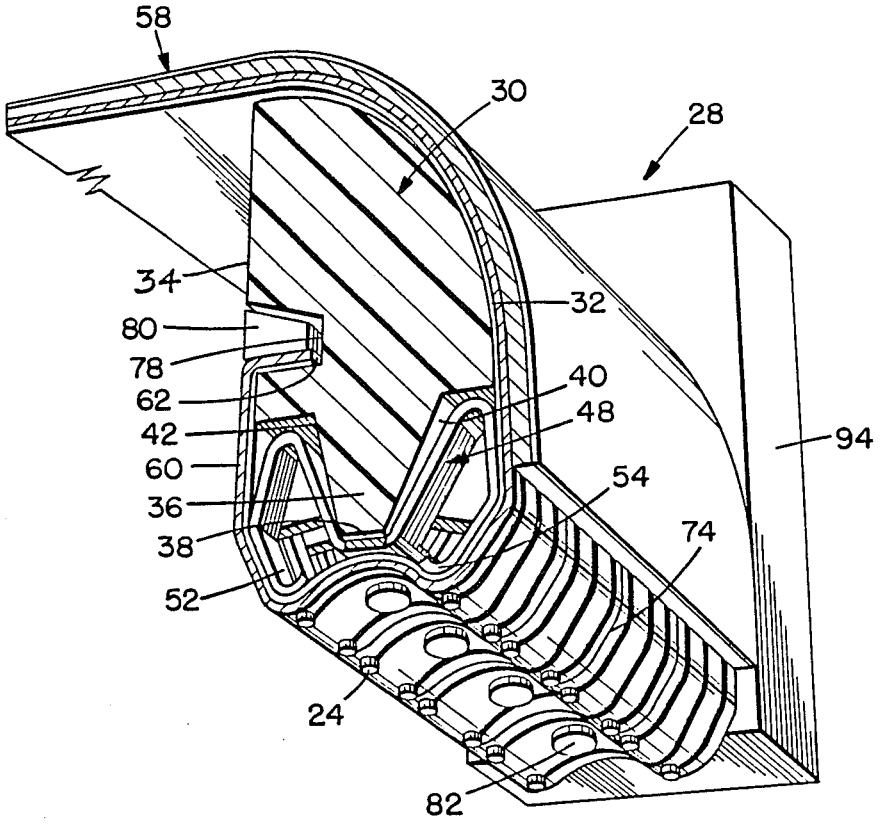
Figure 14:
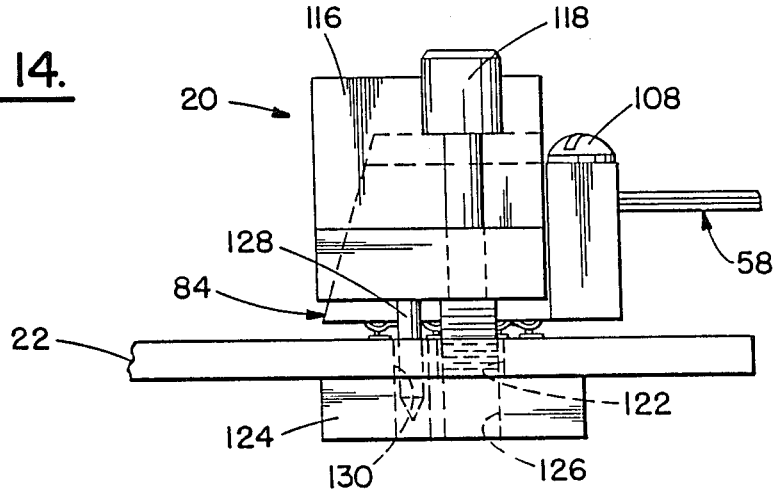
Figure 9:
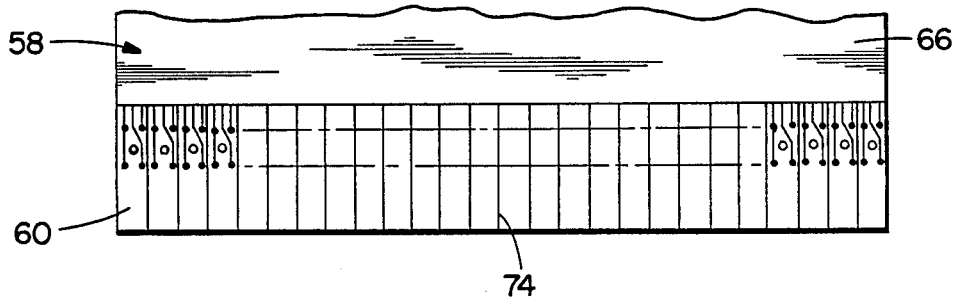
Figure 10:
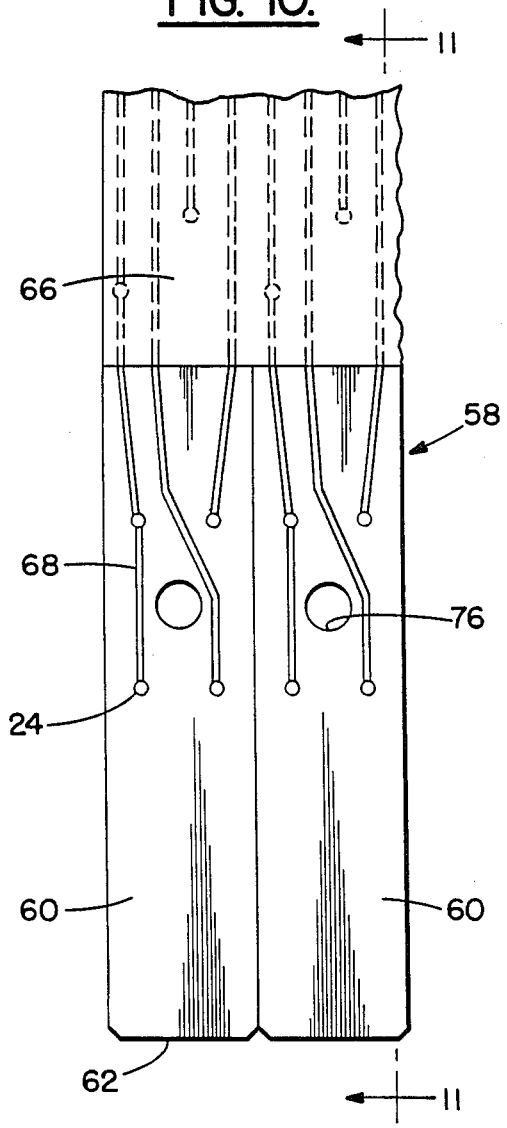
Figure 11:
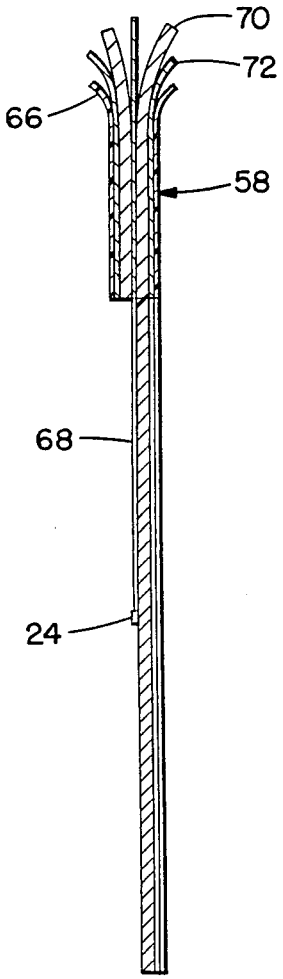
Figure 12:
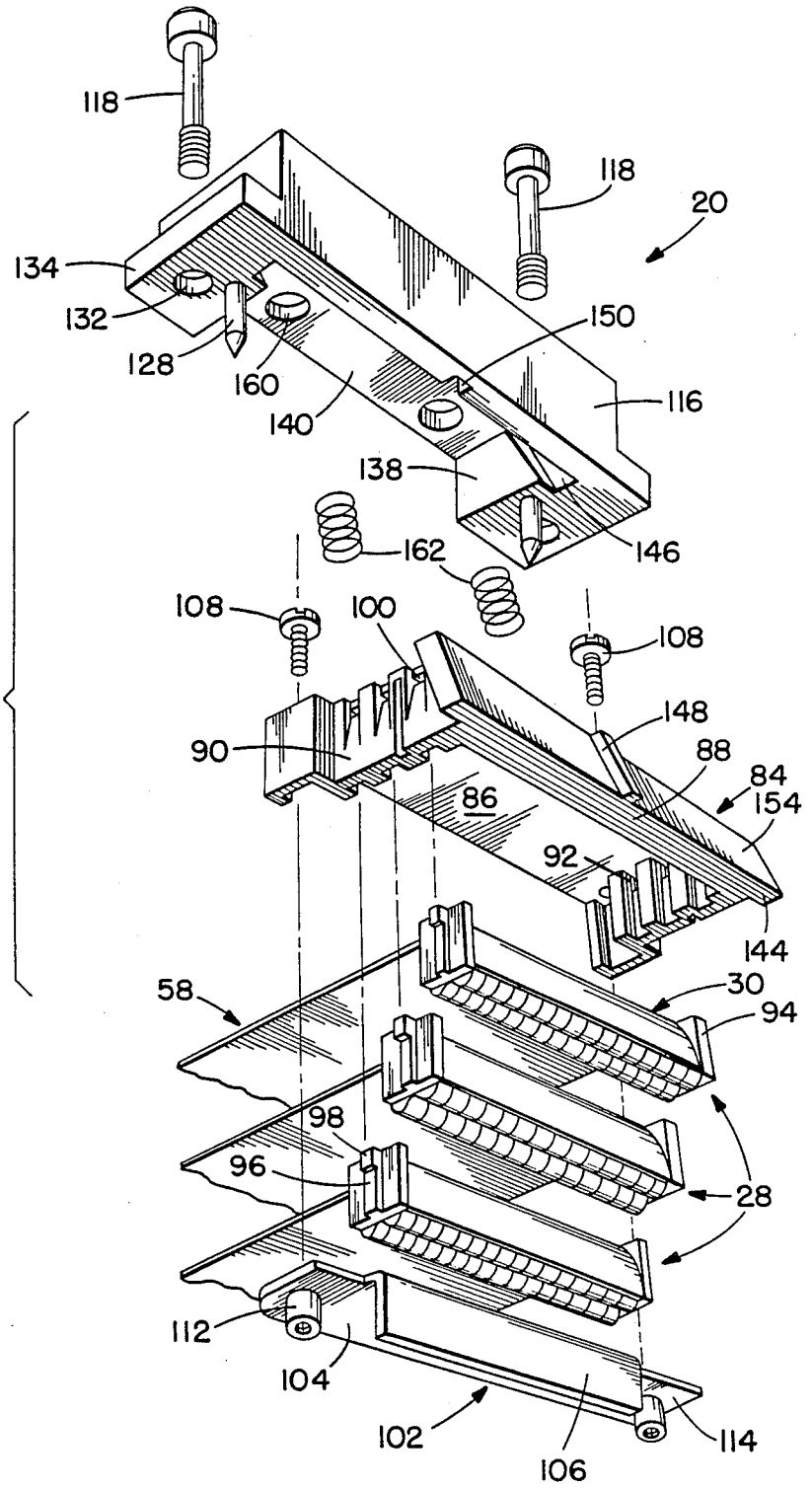
Figure 16:
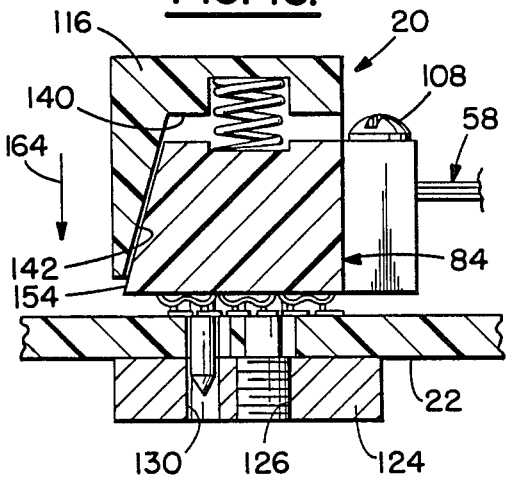
Figure 17:
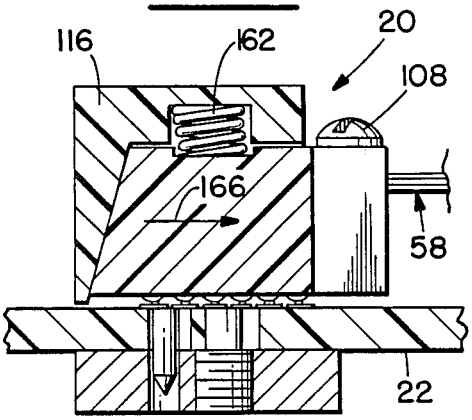
Figure 15:
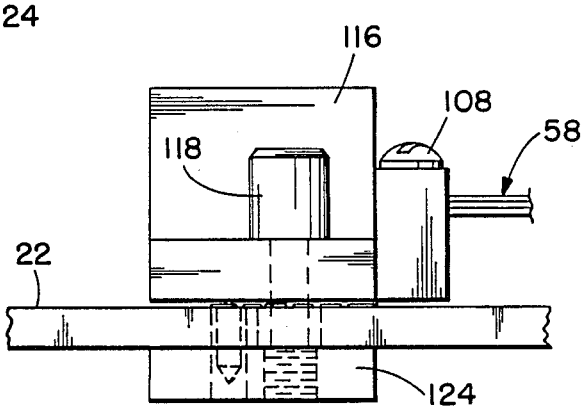
Figure 13:
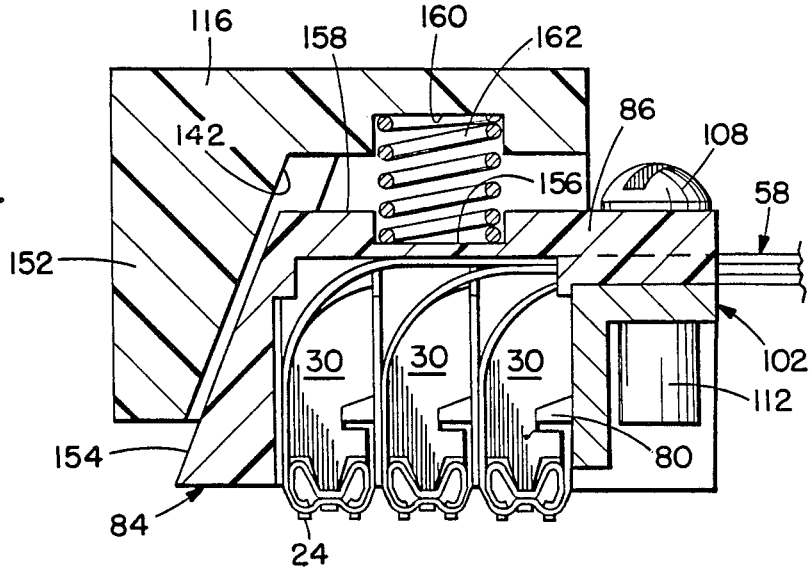

FIGS. 3, 4, and 5 illustrate front elevation, bottom plan, and side elevation views, respectively, of the electrical connector of the invention;

FIG. 6 is an exploded view of the components comprising a subassembly of the electrical connector of the invention;

FIG. 7 is a perspective view of one of the components illustrated in FIG. 6 generally properly aligned with the other components thereof to illustrate a further step in the fabrication of the subassembly;

FIG. 8 is a detail perspective view, certain parts being cut away and shown in section, of the components illustrated in FIG. 6, but now assembled;

FIG. 9 is a detail top plan view illustrating the end regions of stripline ribbon cable which is utilized with the electrical connector of the invention;

FIG. 10 is a detail top plan view illustrating a portion of the stripline ribbon cable illustrated in FIG. 9;

FIG. 11 is a cross section view taken generally along line 11—11 in FIG. 10;

FIG. 12 is an exploded perspective view illustrating a complete electrical connector embodying the invention;

FIG. 13 is a side elevation view, primarily in section, illustrating the components of FIG. 12 in their assembled condition;

FIGS. 14 and 15 are side elevation views illustrating the electrical connector in its initial and final positions, respectively, on a printed circuit board; and FIGS. 16 and 17 are cross section views of the electrical connector generally corresponding to FIGS. 14 and 15.

DESCRIPTION OF THE PREFERRED EMBODIMENT

Figure 1:
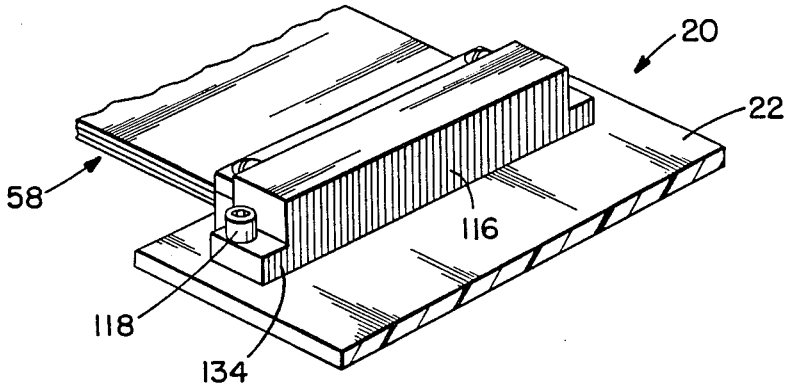
FIG. 1 is a perspective view of an electrical connector assembly illustrating an electrical connector embodying the invention mounted on a printed circuit board.
Figure 2:
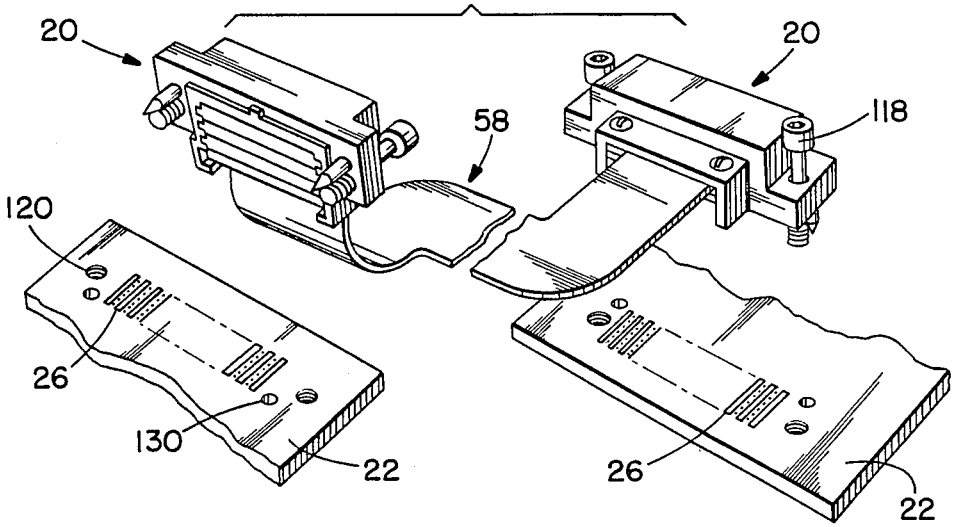
FIG. 2 is an exploded view illustrating a pair of electrical connectors embodying the invention positioned for mounting on associated printed circuit boards.

Turn now to the drawings and initially to FIGS. 1 and 2 which illustrate an electrical connector 20 which embodies the present invention. In FIG. 1, the electrical connector 20 is illustrated as being already mounted on a printed circuit board (PCB) 22 and, in FIG. 2, a pair of electrical connectors 20 are illustrated as being positioned for mounting onto a similar pair of PCBs 22. As seen in FIGS. 3, 4, and 5, each electrical connector 20 has a plurality of contacts 24 which are engageable with mating conductive terminals 26 on each PCB 22 in a manner to be described.

As seen in FIG. 6, the electrical connector 20 includes a plurality of cable holder subassemblies 28 and each such subassembly will now be described with particular attention to FIGS. 7 and 8. A central component of each subassembly 28 is a cable holder block 30 which includes an elongated main body having opposed side walls 32 and 34 and a laterally extending ridge 36. The ridge 36 has an extreme surface 38 distant from the main body and defines a pair of opposed laterally extending recesses 40 and 42. A plurality of parallel, spaced apart ribs 44 in each of the recesses 40, 42 are integral with the main body of the block 30 and said ridge 36 and thereby define a plurality of side-by-side slots 45. The holder block 30 is preferably composed of a heat deformable plastic material and the ridge 36 includes a plurality of outwardly projecting laterally spaced mounting pins 46 for a purpose which will be described subsequently.

With continuing reference to FIGS. 7 and 8, a unitized cable spring array 48 is provided which is preferably stamped from a suitable resilient material, spring steel being a preferred material for strength, consistency of operation, and ease of manufacture. The spring array 48 includes a laterally extending elongated spine 50 and a plurality of pairs of spring members 52, 54 integral with the spine and positioned at spaced locations along the length of the spine. The members 52 and 54 extend in opposite directions from the spine and each is bowed and snuggly received in an associated one of the slots 45 of the holder block 30 and terminates at a free end proximate to, but spaced from the spine. The spine 50 has a plurality of laterally spaced mounting holes 56 positioned for reception over the mounting pins 46 for eventual mounting to the holder block 30 in a manner to be described.

Also comprising a part of the cable holder subassembly 28 is ribbon cable 58 to be terminated on the holder block 30. The ribbon cable 58 is of the "stripline" variety which is, perhaps, more clearly illustrated in FIGS. 9, 10, and 11. The ribbon cable 58 includes a plurality of side-by-side cable strips 60 each of which extends to a tip end 62. A plurality of longitudinally and laterally spaced outwardly projecting contacts 24 are formed thereon generally proximate to, but spaced from, the tip end 62. The ribbon cable 58 includes a suitable outer protective sheath 66 of dielectric material, but that sheath is removed from the end regions of the strips 60 to expose the contacts 24. In addition to the outer sheath 66, the ribbon cable 58 includes a plurality of inner conductors 68, laterally spaced across the cable, which is sandwiched between inner sheaths 70 of dielectric material which, in turn, is sandwiched between sheets of copper shield material 72. Each cable strip 60 is separated from its neighboring strip along a cut or slit line 74 enabling independent relative movement of each strip 60 in directions transverse to the plane of the cable 58. Also formed in each strip 60 at a location intermediate its opposed edges and disposed centrally in a longitudinal direction of the contacts 24 is a mounting hole 76 receivable over an associated one of the mounting pins 46.

FIG. 6 illustrates the relative positioning of the ribbon cable 58 and the holder block 30 as the cable is about to be mounted thereon. However, before the cable 58 is actually attached to the holder block 30, the cable strips 60 are fashioned, as on a mandrel, into the shape illustrated in FIG. 7. The individual components illustrated in FIGS. 6 and 7 are then joined together into the subassembly 28 illustrated in FIG. 8. Specifically, the spring array 48 is mounted onto the holder block 30 so that the spine 50 is contiguous with the extreme surface 38 of the ridge 36 with the mounting pins 46 projecting through associated mounting holes 56 in the spine. Thereafter, the strips 60 of the ribbon cable 58 are mounted onto the holder block 30 so as to be contiguous with the spine 50 and, as in the instance of the spring array 48, with each of the mounting pins 46 projecting through an associated mounting hole 76 in the cable strips.

At this stage of the assembly, the ribbon cable 58 extends in a contiguous manner across the sidewall 32. As seen in FIG. 8, the sidewall 32 has a rounded surface with a generally moderate radius of curvature to guide the ribbon cable as it advances from a distant location for termination. This moderate radius of curvature enables the ribbon cable to change direction while in contiguous engagement with the holder block 30 without causing harm to the cable. Thereupon, the cable 58 is drawn around the spring array 48 such that each of the cable strips 60 is aligned with an associated pair of the spring members 52, 54. The cable strips 60 then advance across the sidewall 32 and are folded for entry into a laterally extending retainer slot 78 formed in the sidewall 34. An elongated resilient retainer member 80 composed of rubber or other elastimeric material is fittingly received in the slot 78 and thereby firmly secures the tip ends 62 of the cable strips 60 to the holder block 30.

The nose end of the cable holder subassembly 28 as now represented by those portions of the cable strip 60 with the contacts 24 thereon is then advanced toward a heated mandrel (not shown) which is shaped in a complimentary fashion to assure that the strips 60 assume the arcuate paths as illustrated in FIG. 8. It was previously mentioned that the holder block 30 is preferably composed of a heat deformable plastic material. Thus, with the application of heat simultaneous with the positioning of the subassembly 28 against the mandrel, the mounting pins 46 are melted, then resolidified into the form of stake bosses 82 as seen in FIG. 8. The stake bosses therefore serve the function of rivets or other suitable fasteners which may be utilized in mounting of the ribbon cable and of the spring array to the holder block.

In the resulting construction of the cable holder subassembly 28 as illustrated in FIG. 8, all of the contacts 24 are substantially coplanar for mating engagement with the terminals 26 on the PCB 22 which are also substantially coplanar. By reason of the construction according to which the ribbon cable 58 is formed into a plurality of individual cable strips 60, each contact 24 is outwardly biased by its own individual spring 52 or 54. In this manner, the subassembly 28 can be designed such that each individual contact 24 receives a minimum force of 100 grams regardless of the dimensional relationship to all of the contacts adjacent to it. That is, even though a contact 24 may be somewhat shorter than its neighbors, it is independent of them and will not adversely effect their ability to contact their mating terminals 26 on the PCB. Thus, the design of the invention assures that each contact 24 will act independently and thereby compensate for any height differences which may exist. Also, because of the desire to assure that each individual contact 24 receives a minimum force of 100 grams, for example, metal springs have been preferably chosen to achieve this result.

It is recognized that elastomeric springs are capable of performing in place of the spring members 52, 54. Nonetheless, while the simplicity of using rubber or other elastomeric material for this purpose is attractive, the ability of elastomeric materials to maintain the high forces over a long period of time in a variety of elevated temperature and other environmental conditions is subject to question. In contrast, the ability of metal alloys to perform this function has been proven for environmental conditions which are considerably more severe than those anticipated in a normal commercial computer application. It is for these reasons that metal springs are preferred.

Turn now to FIGS. 12 and 13 which illustrate the manner in which a plurality of the subassemblies 28 are mounted in a housing 84. The housing 84 is composed of a moderately deformable plastic material and includes a top wall 86, a slanted front wall 88 and spaced apart sidewalls 90 having opposed surfaces and a plurality of generally vertically disposed slots 92 in the opposed surfaces at regularly spaced locations proceeding away from the front wall 88. The housing 84 is open at its rear end opposite the front wall 88. Each cable holder block 30 extends between a pair of integral end plates 94 which lie in parallel planes transverse to the main body. The end plates 94 have integral key members 96 which project outwardly from the end plates in a direction away from the main body of the holder block 30. At the upper end of each key member 96 is a further outwardly projecting tab 98.

The holder blocks 30 are so sized and shaped that, as seen in FIG. 12, the key members 96 are slidably engageable with associated slots 92 in the sidewalls 90 of the housing 84. The sidewalls 90 are further provided with apertures 100 which extend completely through the sidewalls and communicate with the slot 92 adjacent the top wall 86. Thus, as a cable holder block 30 is inserted into the cavity defined by the sidewalls 90, the front wall 88, and the top wall 86, the tabs 98 cause the sidewalls to deform until the tabs are coextensive with the apertures 100 and slidably engage the apertures. This causes the end plates 94 to snap into position contiguous with the sidewalls 90 as the sidewalls recover their original shape. As seen in FIG. 12, this occurs three times. That is, three of the holder blocks 30 are thereby mounted in the housing 84 with the ribbon cable 58 from each successive subassembly 28 overlying and being contiguous with the ribbon cable from the next successive subassembly. This relationship is also seen in FIG. 13.

While the cooperating tabs 98 and apertures 100 operate to firmly secure the holder blocks 30 in the housing 84, a further expedient for this purpose is a cable clamp 102. The cable clamp 102 has a horizontal plate 104 which extends across and is contiguous with the undersurface of a lowermost cable 58 as it extends through the rear opening of the housing 84. A vertical plate 106 bent over from the horizontal plate 104 engages the sidewall 34 of the rearmost holder block 30 to further prevent fore and aft movement of the holder blocks 30 relative to the housing 84. The plate 106 also guards against loosening of the retainer member 80 mounted in the rearmost holder block 30. In a similar fashion, the other retainer members mounted in the other holder blocks are similarly protected from inadvertent loosening or removal by their neighboring subassembly 28. Screws 108, or other suitable fasteners, extend through associated clearance holes 110 formed in the top wall 86 and are threadedly engaged with tapped bosses 112 integral with outwardly extending ears 114 on the cable clamp 102. When the screws 108 are fully tightened, the horizontal plate 104 firmly joins and supports the individual cables 58 against the top wall 86 and the vertical plate 106 prevents fore and aft motion of the individual holder blocks 30 relative to the housing 84.

With continuing reference to FIGS. 12 and 13, electrical connector 20 is seen to include an actuating block 116 which overlies the housing 84 and is mounted to the PCB by means of suitable fasteners 118. The PCB 22 may have tapped holes 120 therein as illustrated in FIG. 1 or may have clearance holes 122 as illustrated in FIG. 14. In the former instance, the fasteners 118 directly engage the PCB 22 while in the later instance, a mounting block or back plane 124 is provided with a tapped hole 126 for threadedly receiving the fastener 118. In either event, the actuating block 116 is provided with a pair of spaced apart, parallel, outwardly projecting alignment pins 128 which are slidably engageable with a mating pair of alignment holes 130 formed in the PCB. The fasteners 118 extend through clearance holes 132 formed in opposed lateral extensions 134 of the actuating block 116.

The actuating block 116 defines a cavity 136 for the slidable reception of the housing 84. The cavity 136 is defined by a pair of opposed side surfaces 138, a terminal surface 140, and a planar cam surface 142 (FIG. 13). A pair of wing members 144 extend in opposite directions from the front wall 88 of the housing 84 and are slidably receivable in complementary slanted slots 146 formed in the side surfaces 138 of the actuating block 116. In a similar manner, a centrally disposed key 148 is slidably received in a complementary slot 150 formed in a front wall 152 of the actuating block 116.

The front wall 88 of the housing 84 also has a planar cam surface 154 which is slidably engageable with the cam surface 142 of the actuating block 116. As seen in FIG. 13, a pair of laterally spaced cylindrical recesses 156 are formed in an upper surface 158 of the top wall 86. Similarly, a pair of spaced cylindrical recesses 160 are formed in the terminal surface 140 of the actuating block 116. The recesses 156 and 160 are substantially opposed when the housing 84 is received within the cavity 136 of the actuating block 116. A suitable compression spring 162 has its opposite ends engaged, respectively, in the recesses 156 and 160 and serves to bias the housing 84 away from the actuating block 116.

OPERATION

The operation of the invention, just described, will now be explained with particular reference to FIGS. 14–17. When it is desired to mount the connector 20 onto the PCB 22, the connector is positioned relative to the PCB such that the alignment pins 128 are positioned for reception into the alignment holes 130 of the PCB (FIG. 14). When this occurs, the contacts 24 on the connector 20 are aligned with their mating terminals 26 on the PCB and the connector 20 rests lightly on the upper surface of the PCB 22. The fasteners 118 are initially raised above the tapped holes 126 of the back plane 124 in the event that that is the mounting construction employed. Of course, the fasteners 118 would be raised above the upper surface of the PCB 22 in the alternative situation in which the construction included tapped holes 120 in the PCB itself. In either event, the fasteners are then engaged with their mating tapped holes to begin the process of fixedly mounting the connector to the PCB.

The springs 162 bias the surfaces 140 and 158 apart. However, when the fasteners 118 become engaged with their associated tapped holes 126 (FIG. 14) and are tightened, continuing tightening of the fasteners moves the actuating block 116 downwardly, that is, in the direction of an arrow 164 and toward the PCB 22. With the cam surfaces 142 and 154 engaged as seen in FIG. 15, downward movement of the actuating block 116 in the direction of the arrow 164 causes rearward movement of the housing 184, that is, in the direction of an arrow 166 (FIG. 17). In turn, this causes the contacts 24 to slide in engagement across the terminals 26. Continued tightening of the fasteners 118 continues to move the actuating block 116 in the direction of the arrow 164 and the housing 84 in the direction of the arrow 166 until the final position illustrated in FIG. 17 is reached. At this point, the surfaces 140 and 158 are engaged and the spring 162 is fully compressed. When this occurs, the electrical connector 20 is firmly secured to the PCB 22 and an optimum electrical connection will have been made between the contacts 24 and their mating terminals 26.

While a preferred embodiment of the invention has been disclosed in detail, it should be understood by those skilled in the art that various modifications may be made to the illustrated embodiments without departing from the scope as described in the specification and defined in the appended claims.

What is claimed is:

1. An electrical connector assembly comprising:

a first component having at least one electrically conductive terminal thereon;

a second component having at least one contact thereon engageable with said terminal and being movable between an initial position and a final position while said contact remains engaged with said terminal, said second component including resilient means biasing said contact toward engagement with said terminal.

2. An electrical connector assembly as set forth in claim 1 wherein said first component is a printed circuit board having a plurality of said terminals thereon;

wherein said second component is a connector having a plurality of said contacts; and wherein each of said contacts is engageable with an associated one of said terminals.

3. An electrical connector assembly as set forth in claim 1 wherein said first component has a plurality of aligned equally spaced terminals thereon; and wherein said second component has a plurality of similarly aligned equally spaced contacts thereon, one of said contacts being engageable with a mating one of said terminals.

4. An electrical connector assembly as set forth in claim 1 wherein said first component has at least two rows each of a plurality of aligned equally spaced terminals thereon; and whereon said second component has at least two rows each of a plurality of similarly aligned equally spaced contacts thereon, one of said contacts being engageable with a mating one of said terminals.

5. An electrical connector assembly as set forth in claim 1 wherein said resilient means is a metal spring.

6. An electrical connector assembly as set forth in claim 1 wherein said second component includes:

a housing having a first cam surface lying in a plane angularly disposed in relation to a plane of engagement of said terminal and said contact; and an actuating block mounted on said first component engaged with said first cam surface for moving said second component between said initial position and said final position, said actuating block being movable between a withdrawn position distant from said first component whereat said housing is in said initial position and an advanced position proximate to said first component whereat said housing is in said final position.

7. An electrical connector assembly as set forth in claim 6.

wherein said first cam surface is planar; and wherein said actuating block has a second cam surface slidably engaged with said first cam surface.

8. An electrical connector assembly as set forth in claim 6, including:

fastener means for mounting said actuating block on said first component;

said resilient means biasing said actuating block toward said withdrawn position.

9. An electrical connector assembly as set forth in claim 8 including:

mutually cooperative positioning means on said actuating block and on said first component for maintaining alignment of said terminal and said contact as said second component moves between said initial and final positions.

10. An electrical connector assembly as set forth in claim 9 wherein said mutually cooperative positioning means include:

a pair of spaced apart, parallel, outwardly projecting alignment pins on said actuating block slidably engageable with a mating pair of holes in said first component.

11. A cable holder subassembly for terminating ribbon cable including a plurality of side by side cable strips, each cable strip having at least a pair of longitudinally spaced outwardly projecting contacts thereon, said subassembly comprising:

a cable holder block including:

an elongated main body having first and second opposed sidewalls and a laterally extending ridge having an extreme surface distant from said main body and defining a pair of opposed laterally extending recesses; and a plurality of parallel, spaced apart ribs in each of the recesses and integral with said main body and said ridge thereby defining a plurality of side by side slots; and a cable spring array including:

a laterally extending elongated spine fixed to said extreme surface of said ridge;

a plurality of pairs of spring members integral with said spine at spaced locations along the length thereof, individual members of each said spring pair extending in opposite directions from said spine, each of said individual spring members being bowed and snugly received in an associated one of the slots of said holder block and terminating at a free end proximate to, but spaced from, said spine;

thereby enabling the cable strips to be drawn across said first sidewall, then around said spring array such that each cable strip is aligned with an associated pair of said spring elements, then across said second sidewall, the cable being fixed, together with said cable spring array, to said extreme surface of said ridge, said free ends of each of said spring members being aligned with an associated contact on an associated cable strip so as to bias the contact in a direction away from said holder block.

12. A cable holder subassembly as set forth in claim 11.

wherein said holder block has a laterally extending retainer slot in said second sidewall adapted to receive the free end of each of the cable strips; and including:

a resilient retainer member fittingly receivable in said slot and engageable with the terminal end of each of the cable strips to firmly secure the cable strips to said holder block.

13. A cable holder subassembly as set forth in claim 11, including:

retainer means for fixing the terminal end of each of the cable strips to said holder block.

14. A cable holder subassembly as set forth in claim 11, including:

a pair of end plates at opposed ends of said main body and integral therewith, said end plates lying in parallel planes transverse to said main body and being engageable with a housing for supporting said subassembly thereon.

15. A cable holder subassembly as set forth in claim 11.

wherein said first sidewall has a rounded surface having a generally moderate radius of curvature in the direction in which the ribbon cable extends to enable the ribbon cable to change direction while in contiguous engagement with said holder block without causing harm thereto.

16. A cable holder subassembly as set forth in claim 11.

wherein said cable spring array is composed of spring metal.

17. A cable holder subassembly comprising:

ribbon cable to be terminated including:

a plurality of side by side cable strips, each of said cable strips extending to a tip end and having at least a pair of longitudinally spaced outwardly projecting contacts thereon proximate to said terminal end;

a cable holder block including:

an elongated main body having first and second opposed sidewalls and a laterally extending ridge having an extreme surface distant from said main body and defining a pair of opposed laterally extending recesses; and a plurality of parallel, spaced apart ribs in each of the recesses and integral with said main body and said ridge thereby defining a plurality of side by side slots; and a cable spring array including:

a laterally extending elongated spine fixed to said extreme surface of said ridge;

a plurality of pairs of spring members integral with said spine at spaced locations along the length thereof, individual members of each said spring pair extending in opposite directions from said spine, each of said individual spring members being bowed and snugly received in an associated one of the slots of said holder block and terminating at a free end proximate to, but spaced from, said spine;

thereby enabling said cable strips to be drawn across said first sidewall, then around said spring array such that each of said cable strips is aligned with an associated pair of said spring elements, then across said second sidewall, said cable being fixed, together with said cable spring array, to said extreme surface of said ridge, said free ends of each of said spring members being aligned with an associated one of said contacts on an associated one of said cable strips so as to bias said contact in a direction away from said holder block.

18. A cable holder subassembly as set forth in claim 17.

wherein said holder block has a laterally extending retainer slot in said second sidewall adapted to receive said free end of each of said cable strips; and including:

a resilient retainer member fittingly receivable in said slot and engageable with said terminal end of each of said cable strips to firmly secure said cable strips to said holder block.

19. A cable holder subassembly as set forth in claim 17, including:

retainer means for fixing said terminal end of each of said cable strips to said holder block.

20. A cable holder subassembly as set forth in claim 17, including:

a pair of end plates at opposed ends of said main body and integral therewith, said end plates lying in parallel planes transverse to said main body and being engageable with a housing for supporting said subassembly thereon.

21. A cable holder subassembly as set forth in claim 17.

wherein said first sidewall has a rounded surface having a generally moderate radius of curvature in the direction in which said ribbon cable extends to enable said ribbon cable to change direction while in contiguous engagement with said holder block without causing harm thereto.

22. A cable holder subassembly as set forth in claim 17.

wherein said ribbon cable is formed in a plurality of layers including an innermost elongate conductor, then successively in both directions transversely of said conductor, an inner sheath of dielectric material, a copper shield, and an outer protective sheath of dielectric material.

23. A cable holder subassembly as set forth in claim 17.

wherein said cable spring array is composed of spring metal.

24. A cable holder subassembly as set forth in claim 17.

wherein said ribbon cable includes an outer protective sheath of dielectric material, said cable being stripped of said protective sheath proximate to its terminal end to expose said contacts, each one of said strips being separated from adjacent ones of said strips to enable independent relative movement in directions transverse to the plane of said cable of said contacts on one of said strips in relation to said contacts on others of said strips.

25. A cable holder subassembly as set forth in claim 24.

wherein said holder block is composed of a heat deformable plastic material, said ridge including a plurality of outwardly projecting laterally spaced mounting pins;

wherein said elongated spine has a plurality of spaced mounting holes positioned for reception over said mounting pins; and wherein each of said strips has a mounting hole therein intermediate said contacts thereon and receivable over an associated one of said mounting pins; and wherein said pins are heat deformed to fix said spine and said strips to said ridge such that all of said contacts lie substantially in a common plane and are the most prominent portions of said subassembly in a direction away from said holder block.

26. A subassembly for an electrical connector assembly comprising:

a housing including a top wall, a front wall, and spaced apart side walls having opposed surfaces and a plurality of generally vertically disposed slots in said opposed surfaces at regularly spaced locations distant from said front wall, said housing being open at its rear end opposite said front wall;

a plurality of cable holder subassemblies receivable for mounting in said housing in a fore and aft relationship, respectively, each of said subassemblies including:

a cable holder block having an elongated main body extending between a pair of integral end plates lying in parallel planes transverse to said main body, said end plates having integral key members projecting outwardly therefrom away from said main body and being slidingly engageable with the slots in said side walls of said housing; and ribbon cable extending from a distant location and terminated on said holder block, said ribbon cable including a plurality of side by side cable strips, each of said cable strips having at least a pair of longitudinally spaced outwardly projecting contacts thereon, said contacts being biased in a direction away from said holder block;

each of said cable holder subassemblies being movable from a distant location into engagement with said housing, said end plates being slidingly received in the slots in said side walls until said cable holder subassembly assumes a seated position proximate to said top wall.

27. A subassembly for an electrical connector assembly as set forth in claim 26.

wherein each of said main bodies has first and second opposed sidewalls, said first and second sidewalls of adjoining ones of said main body being in a contiguous and coextensive relationship when mounted in said housing; and wherein said ribbon cable comprises a plurality of individual cables, one of said individual cables being associated with each of said cable holder subassemblies, said strips lying generally in successive contiguous parallel planes at said rear end of said housing and extending through the open rear end of said housing.

28. A subassembly for an electrical connector assembly as set forth in claim 27.

wherein said housing is deformable;

wherein said sidewalls have apertures extending therethrough communicating with said slots adjacent said top wall; and wherein said end plates of said holder block have outwardly projecting tabs on said key members which cause said housing to deform as said cable holder subassembly advances toward said seated position and engage with associated apertures in said sidewalls whereupon said housing returns to its original shape and thereby retains said cable holder subassembly in said seated position.

29. A subassembly for an electrical connector assembly as set forth in claim 27.

wherein one of said strips lies contiguous to said top wall; and wherein another of said strips has an undersurface which faces away from said top wall; and including:

a cable clamp engageable with said undersurface and mounted on said housing for squeezing said plurality of strips into fixed relationship with said top wall.

30. A subassembly for an electrical connector assembly as set forth in claim 29, including:

fastener means for joining said cable clamp to said housing.

31. A subassembly for an electrical connector assembly as set forth in claim 26, comprising:

resilient means on said holder block for biasing said contacts in a direction away from said holder block.

32. A subassembly for an electrical connector assembly as set forth in claim 31 wherein said resilient means is a metal spring.

33. A subassembly for an electrical connector assembly as set forth in claim 31 wherein said holder block includes:

first and second opposed sidewalls on said main body and a laterally extending ridge thereon having an extreme surface distant from said main body and defining a pair of opposed laterally extending recesses; and a plurality of parallel, spaced apart ribs in each of the recesses and integral with said main body and said ridge thereby defining a plurality of side by side slots; and wherein said resilient means is a cable spring array including: a laterally extending elongated spine fixed to said extreme surface of said ridge;

a plurality of pairs of spring members integral with said spine at spaced locations along the length thereof, individual members of each said spring pair extending in opposite directions from said spine, each of said individual spring members being bowed and snugly received in an associated one of the slots of said holder block and terminating at a free end proximate to, but spaced from, said spine;

thereby enabling said cable strips to be drawn across said first sidewall, then around said spring array such that each of said cable strips is aligned with an associated pair of said spring elements, then across said second sidewall, said cable being fixed, together with said cable spring array, to said extreme surface of said ridge, said free ends of each of said spring members being aligned with an associated one of said contacts on an associated one of said cable strips so as to bias said contact in a direction away from said holder block.

34. A cable holder subassembly as set forth in claim 33.

wherein said holder block has a laterally extending retainer slot in said second sidewall adapted to receive said free end of each of said cable strips; and including:

a resilient retainer member fittingly receivable in said slot and engageable with said terminal end of each of said cable strips to firmly secure said cable strips to said holder block.

35. A cable holder subassembly as set forth in claim 33. wherein said first sidewall has a rounded surface having a generally moderate radius of curvature in the direction in which said ribbon cable extends to enable said ribbon cable to change direction while in contiguous engagement with said holder block without causing harm thereto.

36. A cable holder subassembly as set forth in claim 33.

wherein said ribbon cable is formed in a plurality of layers including an innermost elongate conductor, then successively in both directions transversely of said conductor, an inner sheath of dielectric material, a copper shield, and an outer protective sheath of dielectric material.

37. A cable holder subassembly as set forth in claim 33.

wherein said ribbon cable includes an outer protective sheath of dielectric material, said protective sheath being removed from said cable proximate to its tip end to expose said contacts, each one of said strips being separated from adjacent ones of said strips to enable independent relative movement in directions transverse to the plane of said cable of said contacts on one of said strips in relation to said contacts on others of said strips.

38. A cable holder subassembly as set forth in claim 37.

wherein said holder block is composed of a heat deformable plastic material, said ridge including a plurality of outwardly projecting laterally spaced mounting pins;

wherein said elongated spine has a plurality of spaced mounting holes positioned for reception over said mounting pins; and wherein each of said strips has a mounting hole therein intermediate said contacts thereon and receivable over an associated one of said mounting pins; and wherein said pins are heat deformed to fix said spine and said strips to said ridge such that all of said contacts lie substantially in a common plane and are the most prominent portions of said subassembly in a direction away from said holder block.

39. An electrical connector for mounting on a first component having at least one electrically conductive terminal thereon comprising:

a second component having at least one contact thereon engageable with the terminal and being movable between an initial position and a final position while said contact remains engaged with the terminal, said second component including resilient means biasing said contact toward engagement with said terminal.

40. An electrical connector assembly as set forth in claim 39.

wherein the first component is a printed circuit board having a plurality of terminals thereon;

wherein said second component is a connector having a plurality of said contacts; and wherein each of said contacts is engageable with an associated one of the terminals.

41. An electrical connector assembly as set forth in claim 39 wherein said second component has a plurality of aligned equally spaced contacts thereon, one of said contacts being engageable with a mating one of a plurality of similarly aligned equally spaced terminals on the first component.

42. An electrical connector assembly as set forth in claim 39 wherein said second component has at least two rows each of a plurality of aligned equally spaced contacts thereon, one of said contacts being engageable with a mating one of a plurality of similarly aligned and spaced terminals on the first component.

43. An electrical connector assembly as set forth in claim 39.

wherein said resilient means is a metal spring.

44. An electrical connector as set forth in claim 39.

wherein said second component includes:

a housing having a first cam surface lying in a plane angularly disposed in relation to a plane of engagement of the terminal and said said contact; and an actuating block mounted on the first component engaged with said first cam surface for moving said second component between said initial position and said final position, said actuating block being movable between a withdrawn position distant from the first component whereat said housing is in said initial position and an advanced position proximate to the first component whereat said housing is in said final position.

45. An electrical connector assembly as set forth in claim 44.

wherein said first cam surface is planar; and wherein said actuating block has a second planar cam surface slidably engaged with said first cam surface.

46. An electrical connector as set forth in claim 44, including:

fastener means for mounting said actuating block on the first component;

said resilient means biasing said actuating block toward said withdrawn position.

47. An electrical connector assembly as set forth in claim 46 including:

mutually cooperative positioning means on said actuating block and on the first component for maintaining alignment of the terminal an said contact as said second component moves between said initial and final positions.

48. An electrical connector assembly as set forth in claim 47.

wherein said mutually cooperative positioning means include: a pair of spaced apart, parallel, outwardly projecting alignment pins on said actuating block slidably engageable with a mating pair of holes in the first component.

49. An electrical connector as set forth in claim 48.

wherein said housing has an upper surface and said first cam surface thereon is planar;

wherein said actuating block overlies said housing and includes:

a second planar cam surface slidably engaged with said first cam surface; and a terminal surface engaged with said upper surface when said housing is in said final position.

50. An electrical connector as set forth in claim 49.

wherein said resilient means is positioned between said housing and said actuating block for biasing said terminal surface away from said upper surface. pg,58

51. An electrical connector as set forth in claim 50.

wherein said resilient means is a compression spring which is compressed when said terminal surface is engaged with said upper surface.

* * * * *